US005606223A

United States Patent [19]

Yamamoto et al.

[11] Patent Number: 5,606,223

[45] Date of Patent: Feb. 25, 1997

[54] LUMINAIRE OF REDUCED NOISE WITH MAGNETIC FIELD CANCELLED

[75] Inventors: Minoru Yamamoto; Hiroyasu Eriguchi; Takeshi Kamoi, all of Kadoma, Japan

[73] Assignee: Matsushita Electric Works, Ltd., Osaka, Japan

[21] Appl. No.: 264,713

[22] Filed: Jun. 23, 1994

[30] Foreign Application Priority Data

Jun. 25, 1993 [JP] Japan ..... 5-155750
Jul. 15, 1993 [JP] Japan ..... 5-175735

[51] Int. Cl.[6] ..... H01J 7/44; H01J 61/02; H05B 41/24

[52] U.S. Cl. ..... 315/85; 315/248; 313/113; 313/313; 313/634; 313/114

[58] Field of Search ..... 315/85, 248, 57; 313/113, 479, 313, 634, 114

[56] References Cited

U.S. PATENT DOCUMENTS

| | | | |
|---|---|---|---|
| 4,240,010 | 12/1980 | Buhrer | 315/248 |
| 4,245,179 | 1/1981 | Buhrer | 315/248 |
| 4,409,521 | 10/1983 | Roberts | 315/57 |
| 4,922,392 | 5/1990 | Egami et al. | 362/217 |
| 5,195,822 | 3/1993 | Takahashi et al. | 362/296 |
| 5,349,271 | 9/1994 | Van Os et al. | 315/248 |

FOREIGN PATENT DOCUMENTS

| | | | |
|---|---|---|---|
| 515987 | 3/1993 | Japan . | |
| 5159887 | 4/1993 | Japan . | |
| 448707 | 9/1934 | United Kingdom . | |
| 2066559 | 11/1980 | United Kingdom . | |
| 2095490 | 8/1982 | United Kingdom . | |
| 2138629 | 10/1984 | United Kingdom | 315/85 |

*Primary Examiner*—Robert Pascal
*Assistant Examiner*—Arnold Kinkead

[57] ABSTRACT

A luminaire includes a lamp connected at one electrode to an ordinary current loop and at the other electrode to the other current loop which is branched into more than two which are extending along two opposite sides of the lamp. Magnetic fields produced thus in the branched loops act to cancel each other, and any noise occurring due to generation of the magnetic field can be remarkably reduced.

5 Claims, 14 Drawing Sheets

LUMINAIRE OF REDUCED NOISE WITH MAGNETIC FIELD CANCELLED

BACKGROUND OF THE INVENTION

This invention relates to a luminaire for lighting such light source as a high pressure discharge lamp, fluorescent lamp, incandescent lamp or the like with a high frequency or a current containing a high frequency ripple component.

DESCRIPTION OF RELATED ART

Generally, as a circuit for lighting fluorescent lamp there has been widely used an expedient of lighting the lamp with a high frequency at such level as several tens of kHz, for the purpose of minumizing the size and weight. In an event where, in particular, such high intensity discharge lamp (which shall be hereinafter referred to as "HID lamp") as a metal halide lamp, mercury lamp, high-pressure sodium lamp or the like is employed in the luminaire, the lighting of such lamp at a lighting frequency employed for general fluorescent lamps is likely to cause an acoustic resonance phenomenon to occur so as to render discharge arc to be unstable, resulting in a problem that a flicker or extinction occurs, and even the lamp itself is damaged according to circumstances.

In order to eliminate such problems, there have been employed various measures, one of which is to light the lamp with a high frequency selected to be of a level causing no acoustic resonance to occur. While this lighting frequency is under the control of the type or wattage of the lamp, it reaches generally 100 to several hundred kHz, and it is demanded that the lamp is lighted with a frequency considerably higher than generally utilized for the fluorescent lamps. Thus, it is possible to effectively realize a stable lighting of the HID lamp by lighting the same at the high frequency level which does not cause acoustic resonance, the lighting device is thereby constituted for a high frequency operation, and the minimization in size and weight can be realized to a remarkable extent. When the high frequency lighting is executed at the level not causing the acoustic resonance, however, there arises a remarkable problem that noises are generated in practice, and remarkable noises will be likely to give to ambient machines and devices such undesirable influence as a malfunction.

As an expedience for reducing the noise, it has been suggested to make an area of loop through which a lamp current flows to be smaller, since it is theoretically possible to reduce the noise by reducing the area of loop. However, it is practically not suitable because the reduction of the area of loop results in a disposition of lead wires to be closer to the lamp the surface temperature of which reaches such extremely high temperature as 500° to 600° C. and the lead wires are subjected to a thermal deterioration.

Other expediences for the noise reduction have been disclosed in U.S. Pat. Nos. 4,922,392 and 5,195,822, in which it is suggested to provide a magnetic shield to the discharge lamp by covering part of the periphery of the lamp with a metallic plate, wire net or electrically conductive resin. This provision of the magnetic shield may be able to restrain the noise to some extent, but the magnetic shield of U.S. Pat. No. 4,922,392 fails to teach any measures for functioning the magnetic shield during stationary lighting operation of the lamp, though useful in restraining the noise occurring in waiting operation of the lamp, and the problem in respect of the noise restraining during the stationary lighting operation is left unsolved. Further, the magnetic shield of U.S. Pat. No. 4,922,392 still involves problems that the same is costly and the arrangement is insufficient in compatibility with other types of discharge lamps. In the case of U.S. Pat. No. 5,195,822, further, there arises a risk that the temperature of the discharge lamp itself rises excessively to give to the life of the lamp undesirable influence, while the measures disclosed in this U.S. Patent also involves such problems that the arrangement is costly and is insufficient in the compatibility with other type of the lamp.

While another noise restraining measure is disclosed in Japanese Patent Laid-Open Publication No. 5-159887, a luminaire shown to have the noise restraining measure disclosed is limited only to the use with circular lamps and is difficult to be used as applied to straight tube lamps or other types of the lamp, and is poor in the compatibility.

SUMMARY OF THE INVENTION

It is a primary object of the present invention, therefore, to provide a luminaire which has eliminated the foregoing problems of the known art and is capable of effectively reducing the noise occurring in lighting lamps with high frequency current or a current including high frequency ripple component.

The above object of the present invention can be established by means of a luminaire in which a lighting means is connected to a power source, and a lamp is connected at one electrode to one of a pair of connection terminals of the lighting means and at the other electrode to the other connection terminal of the lighting means respectively through a wiring loop, characterized in that the wiring loop interposed with respect to the other electrode of the lamp is branched into more than two portions which extend along two opposite sides of the lamp and are connected to the other electrode of the lamp.

Other objects and advantages of the present invention should become clear as the description of the invention advances as detailed in the followings with reference to preferred embodiments shown in accompanying drawings.

BRIEF DESCRIPTION OF THE DRAWINGS

FIGS. 6*a*, 6*b* through 9 are explanatory views for various working aspects employable in the embodiment of FIGS. 4 and 5;

While the present invention should be described in the followings as detailed with reference to the respective embodiments shown in the accompanying drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Figure 1:
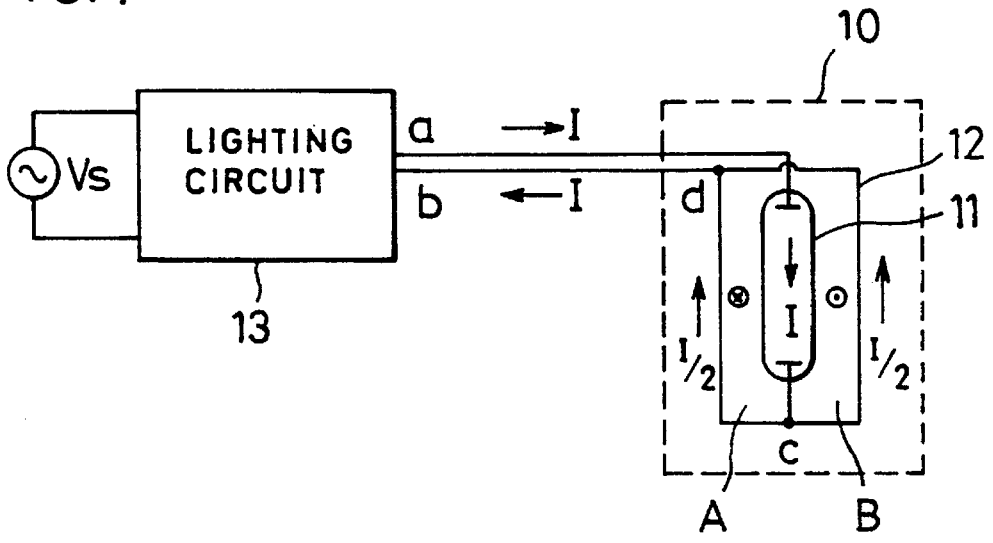
FIG. 1 is a schematic circuit diagram of the luminaire according to the present invention.

Referring here to FIG. 1, the present invention adopts a lamp circuit 10 including a lamp 11, in which a loop 12 of a current flowing through the lamp 11 is connected to one of opposing electrodes of the lamp 11 in ordinary manner but to the other electrode of the lamp 11 at a base end or junction point of two or more branched loop portions which extend along the lamp 11 respectively. In other words, the current loop 12 connected to both electrodes of the lamp 11 is connected at both ends to a pair of connecting terminals a and b of a lighting circuit 13 connected to a power source Vs, while the branched loop portions connected to the other electrode of the lamp 11 is branched, more concretely, at point c, from which the loop portions are extended along both opposing sides of the lamp 11, disposing thus the lamp 11 between the branched loop portions, and are again joined at point d which is connected to the connecting terminal b of the lighting circuit 13. Thus the branched loop portions are forming a coil of a single turn with the lamp 11 included as part of the loop portions, and the magnetic fields generated from the respective branched loop portions are respectively in the direction intercepting at right angles the loop portions and mutually to be in reverse polarities. That is, the magnetic fluxes generated from the respective branched loop portions are mutually acting to cancel each other, so that the noise due to magnetic field component generated from an area adjacent to the lamp 11 to the exterior can be remarkably reduced. On the other hand, the electric current flowing through the respective branched loop portions which are two here will be about one half of the normal lamp current. The magnetic fields generated by the branched loop portions at this time are respectively of the intensity proportional to the current flowing in the respective loop portions so that, as the current has been reduced to be half, that is, I/2, the magnetic fields generated by the respective branched loop portions can be reduced to be half, and the noise yielded around the lamp 11 can be remarkably reduced.

Figure 2:
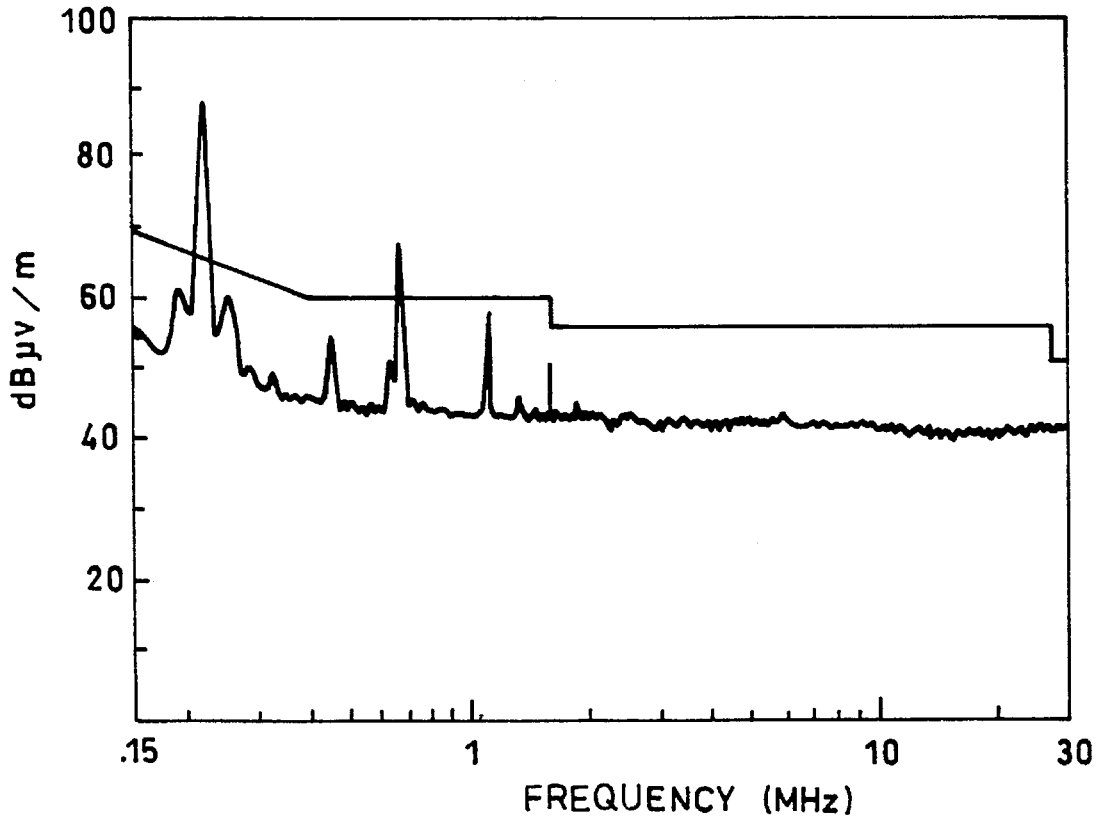
FIGS. 2 and 3 are graphs showing comparison data for clarifying the function attained by the luminaire of FIG. 1.
Figure 3:
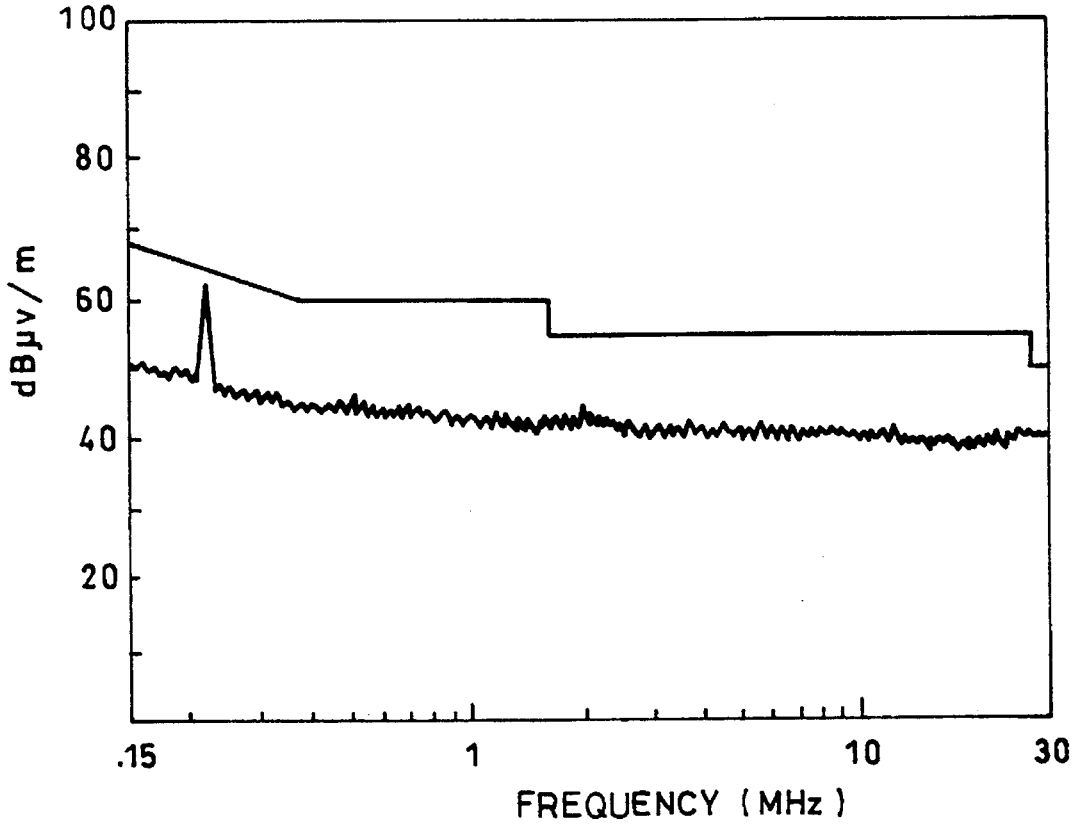

Now, while the results of measurement of the radiation noise occurring in an arrangement where the current flowing through the lamp 11 is not branched in contrast to such arrangement as in FIG. 1 where the current is branched (to be I/2) are as shown in FIG. 2, the results of similar measurement with respect to an arrangement where the current is branched have been as shown in FIG. 3. As the lamp 11, a metal halide lamp of 150 W was employed here as lighted with a high frequency. Further, in respect of the area of loop connected to the other electrode of the lamp, the area of the respective branched loops was made substantially the same as that in the case where the current was not branched. In FIGS. 2 and 3, the noise frequency is taken on the abscissa while the noise level is taken on the ordinate, and it has been found that, as will be clear when both graphs are compared with each other, the noise occurring around basic frequency component 220 kHz in particular. Also in this case the noise of high harmonic wave component was almost not caused to be generated, and the noise reduction effect could have been sufficiently achieved.

Figure 4:
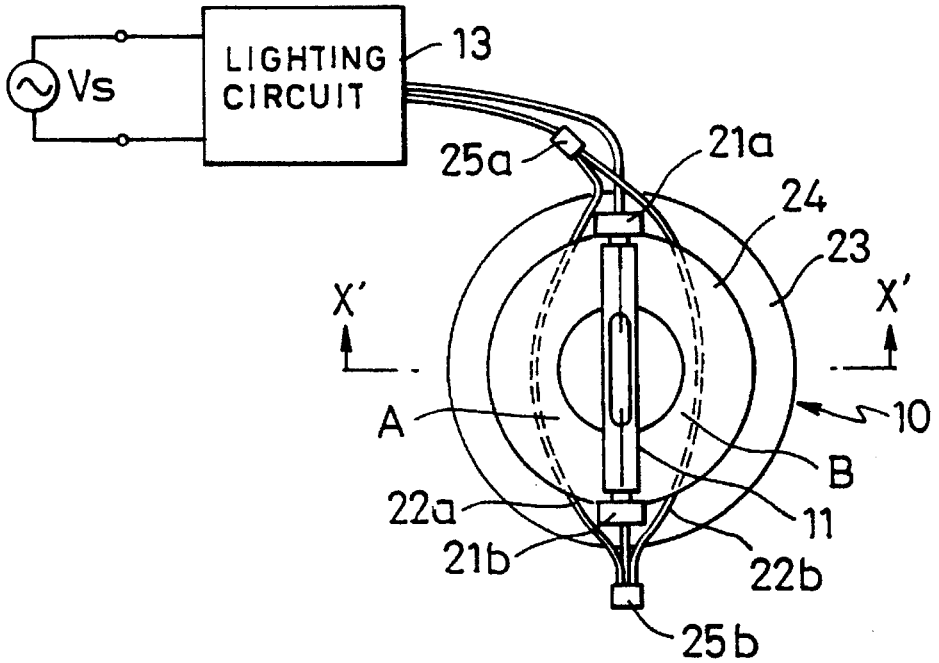
FIG. 4 is an explanatory view for a basic embodiment of the present invention.

Referring next to FIG. 4, there is shown a concrete embodiment of the basic arrangement shown in FIG. 1. In the present instance, the lamp circuit 10 includes an HID Lamp 11 suitable for use as a down-light equipment, for example, one of the connecting terminals of the lighting circuit 13 is connected in normal manner and directly to one lamp holder 21*a* connected to one electrode of the lamp 11, and the other connecting terminal of the lighting circuit 13 is branched at a connector 25*a* into two wiring paths 22*a* and 22*b* which are extended along both opposite sides of the lamp 11 and joined again at the other connector 25*b* connected through the other lamp holder 21*b* to the other electrode of the lamp 11. In this case, it is optimum that the loops A and B formed by each of the branched wiring paths 22*a* and 22*b* and the lamp 11 are made substantially to be of the same area. With the present embodiment, the same function as that described with reference to FIG. 1 can be obtained, and the noise generated from the zone adjacent to the lamp 11 can be effectively restrained.

Figure 5:
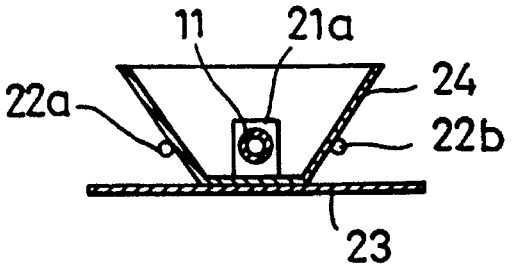
FIG. 5 is a schematic sectioned view of the luminaire in the embodiment of FIG. 4.
Figure 6A:
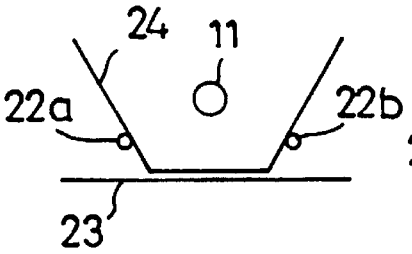
Figure 6B:
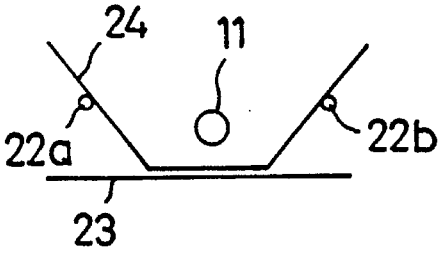
Figure 7:
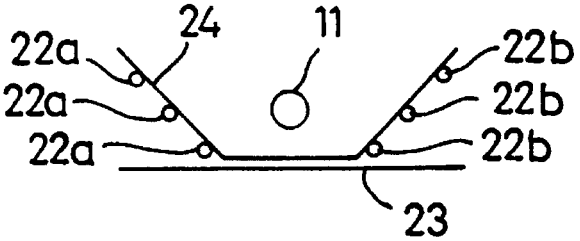

Here, the loop formed by one branched wiring path 22*a* and the lamp 11 and the other loop formed by the other branched wiring path 22*b* and the lamp 11 are disposed on the same plane as shown in FIG. 5. It is also possible to dispose both planes respectively including each of the branched wiring paths 22*a* and 22*b* so as to intersect each other as shown in FIGS. 6*a* and 6*b*. In this case, the configuration of the branched wiring paths 22*a* and 22*b* may be circular, arcuate or any polygonal shape. Further, each of the branched wiring paths 22*a* and 22*b* may be divided into two or more sections, as shown in FIG. 7 in which aspect the division is three. In these aspects of the embodiment of FIG. 4, the lamp 11 of the luminaire is supported with a top plate 23 and a reflector plate 24.

Figure 8:
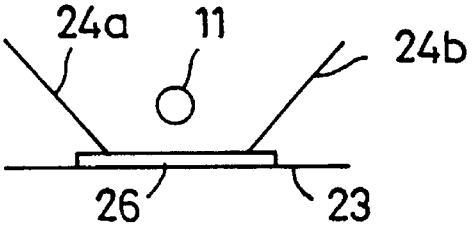
Figure 9:
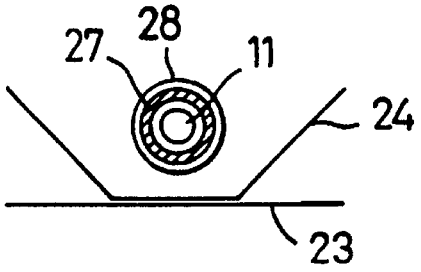

Further, in another aspect shown in FIG. 8, the branched wiring paths are provided in the form of a pair of reflector plates 24*a* and 24*b* of a conductive material, in which event the reflector plates 24*a* and 24*b* are secured to the top plate 23 through an insulating plate 26 interposed between them. It is also possible to employ such arrangement as shown in FIG. 9, in which a transparent and electrically conducting film 27 is provided on the outer periphery of the lamp 11 and covered with a transparent glass 28, and the lamp current is made to flow through the transparent, conducting film 27.

Figure 10A:
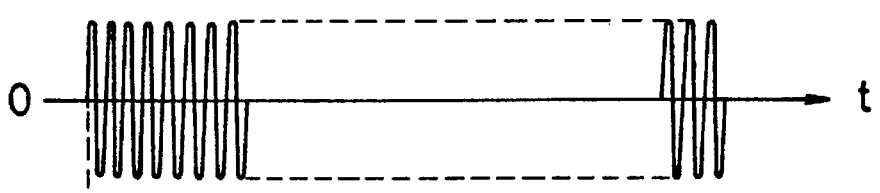
FIGS. 10(*a*) through 10(*c*) are wave-form diagrams of lamp current in the embodiments of FIG. 1 and FIGS. 4 and 5.
Figure 10B:
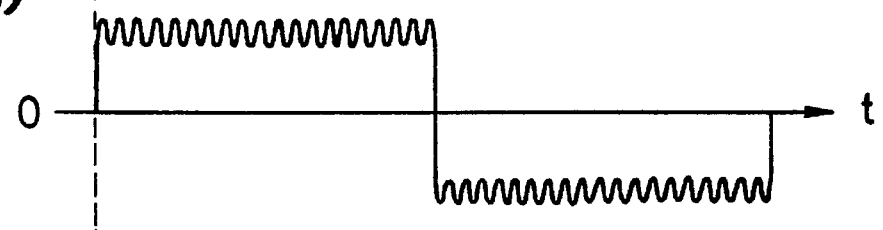
Figure 10C:
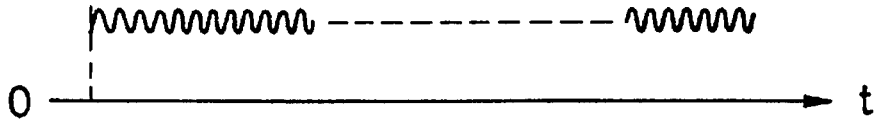

Now, while the lamp 11 may be lighted with the high frequency by supplying such high frequency current as shown in FIG. 10(*a*) to the lamp 11, any other lighting system than the high frequency lighting system may be employed. As an electronic lighting circuit for the HID lamp, for example, it is also useful to employ a rectangular-wave lighting system, in which event, though the lamp current includes at a certain ratio the ripple component which may cause noise to occur, the lamp current supply through the branched wiring paths allows the noise occurrence to be sufficiently reduced. In practice, it has been found that, in the high frequency lighting system of FIG. 10(*a*), the use of the branched wiring paths is extremely effective to restrain noise so long as the lighting frequency is limited at least up to 500 kHz.

Figure 11:
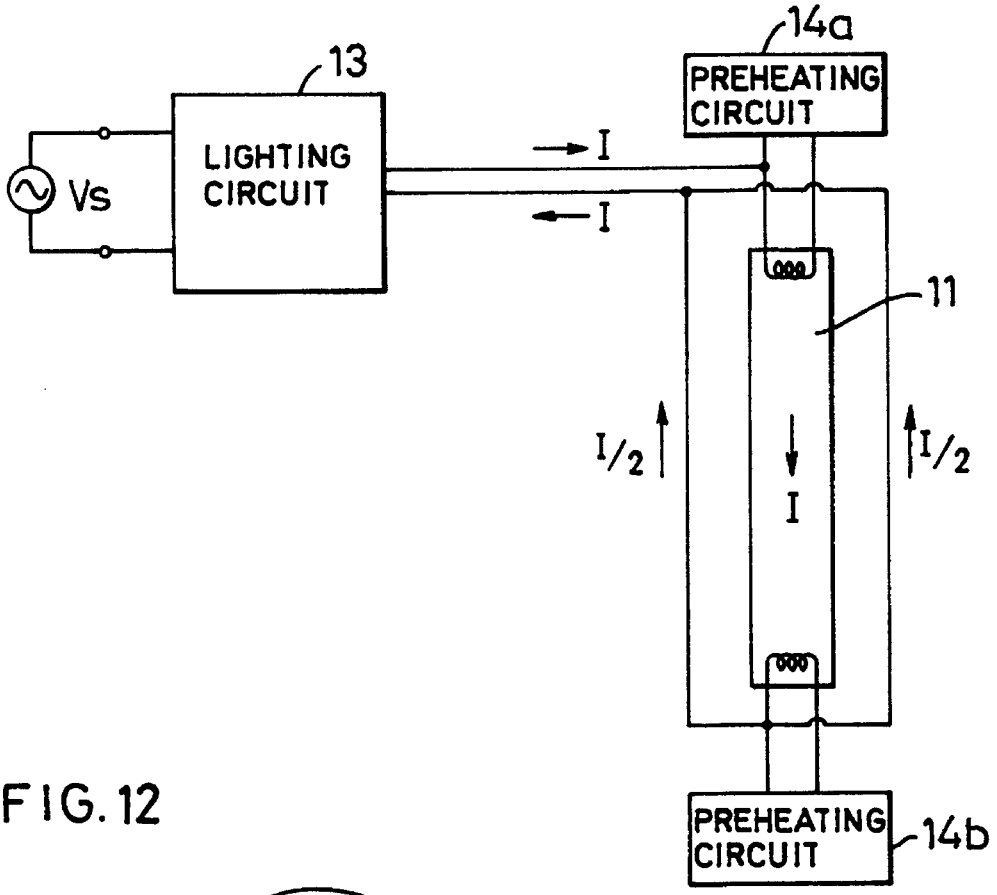
FIGS. 11 through 14 show in schematic elevations various other embodiments of the present invention.

In FIG. 11, another embodiment of the present invention is shown, in which a typical fluorescent lamp is used as the lamp 11, and the lighting circuit 13 is connected to this fluorescent lamp in such loop arrangement as has been described with reference to FIG. 1. To the respective electrodes of this fluorescent lamp 11, preferably, preheating circuits 14*a* and 14*b* are provided for the purpose of stabilizing the starting of the lighting. While in this arrangement the fluorescent lamp is longer than in the case of the HID lamp and the noise occurrence is likely to be increased, the loop arrangement along the length of the lamp is effective to restrain the noise occurrence.

Figure 12:
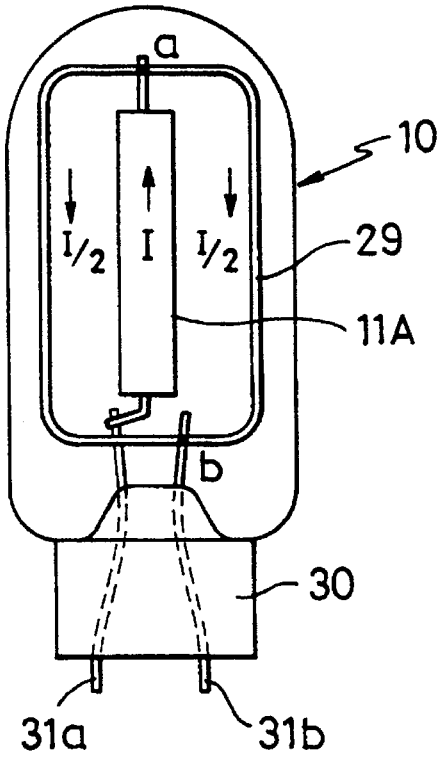

In FIG. 12, another embodiment of the present invention is shown, in which the lamp current is branched in the interior space of the lamp. More specifically, one of two lead wires of opposite polarities of a luminous tube 11A of the luminaire 10 is connected at point a to a loop means 29 which is connected at point b to one 31*b* of terminal pins 31*a* and 31*b* the other 31*a* of which is connected to the other lead wire of the luminous tube 11A, while the loop means 29 extends along both sides of the luminous tube 11A. Thus, in this arrangement, too, the loop means 29 is equivalent to the loop arrangement described with reference to FIG. 1, so that the magnetic fields occurring as the cause of the noise are erased in the interior of lamp or luminaire housing, and the noise can be effectively prevented from occurring.

Figure 13:
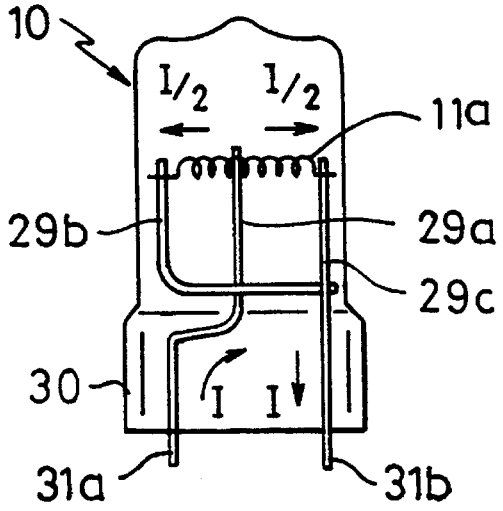
Figure 14:
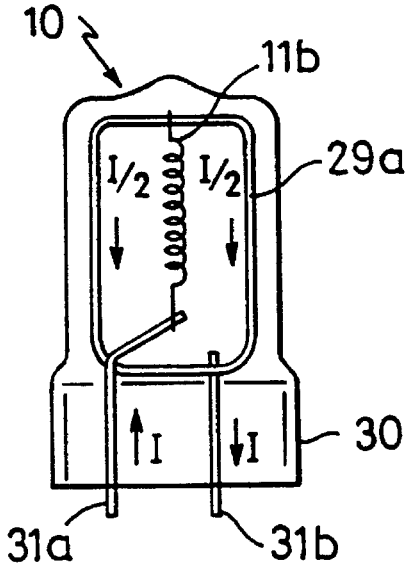

In another embodiment shown in FIG. 13, an incandescent lamp is employed as the lamp 11, in which wiring loop means having sections 29*a*–29*c* is connected to terminal pins 31*a* and 31*b* held through a lamp base 30, and a filament 11*a* is connected in the center to the loop section 29*a* connected to the terminal 31*a* and at both ends to remaining two loop sections 29*b* and 29*c* connected commonly to the other terminal 31*b*. Accordingly, the same loop arrangement as in the foregoing embodiments of FIGS. 1 through 12 is obtained also in the present embodiment, and the noise occurrence can be effectively reatrained. The loop means can be formed also in the loop shape as denoted by 29*a* in FIG. 14 of still another embodiment of the present invention, in which the loop means 29*a* is disposed within an incandescent lamp to extend along the filament 11*b* which is connected at an end to the loop means 29*a* and to one terminal pin 31*b* and at the other end to the other terminal pin 31*a*. With this arrangement, the same loop arrangement as in the foregoing embodiments of FIGS. 1 through 12 can be obtained and the effective noise reduction can be attained.

Figure 15:
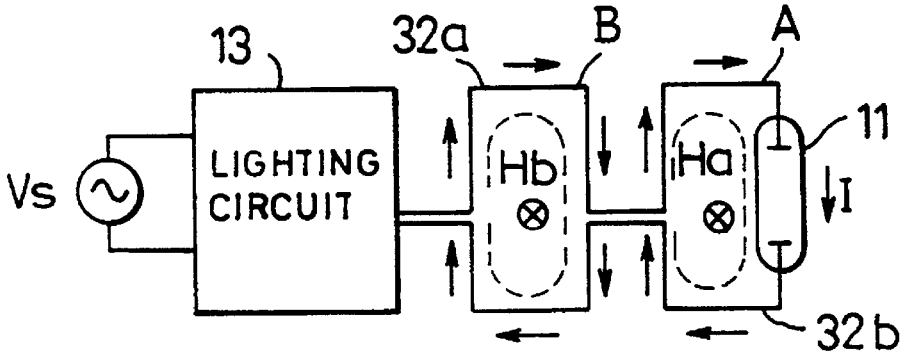
FIG. 15 shows in a schematic circuit diagram another embodiment according to the present invention.
Figure 16:
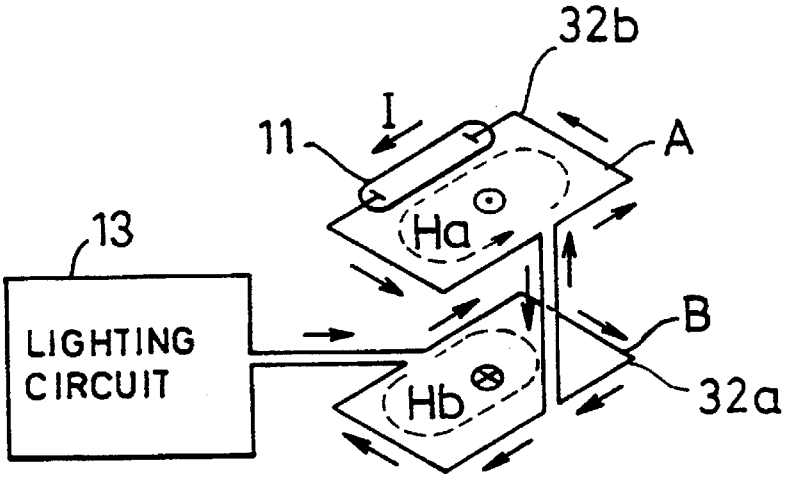
FIG. 16 is a more concrete explanatory view for the embodiment of FIG. 15.

Referring to FIG. 15, there is shown another embodiment of the present invention, in which the HID lamp is employed as the lamp 11, and both terminals of the lamp 11 are formed to provide two loop means 32*a* and 32*b* substantially of the same configuration and a pair of current loop regions A and B. In the present instance, practically, the loop means 32*a* and 32*b* are disposed in two stairs as shown in FIG. 16, while one loop means 32*a* of the lower stair is directly connected to the lighting circuit 13, and the other loop means 32*b* including the lamp 11 is the higher stair, so that the loop regions A and B are formed in the upper and lower positional relationship. In the present embodiment, the magnetic field generated in the loop region A is capable of cancelling the magnetic field generated in the loop region B, and the noise occurrence can be reliably restrained substantially in the same manner as in the embodiments of FIGS. 1 through 12.

Figure 17:
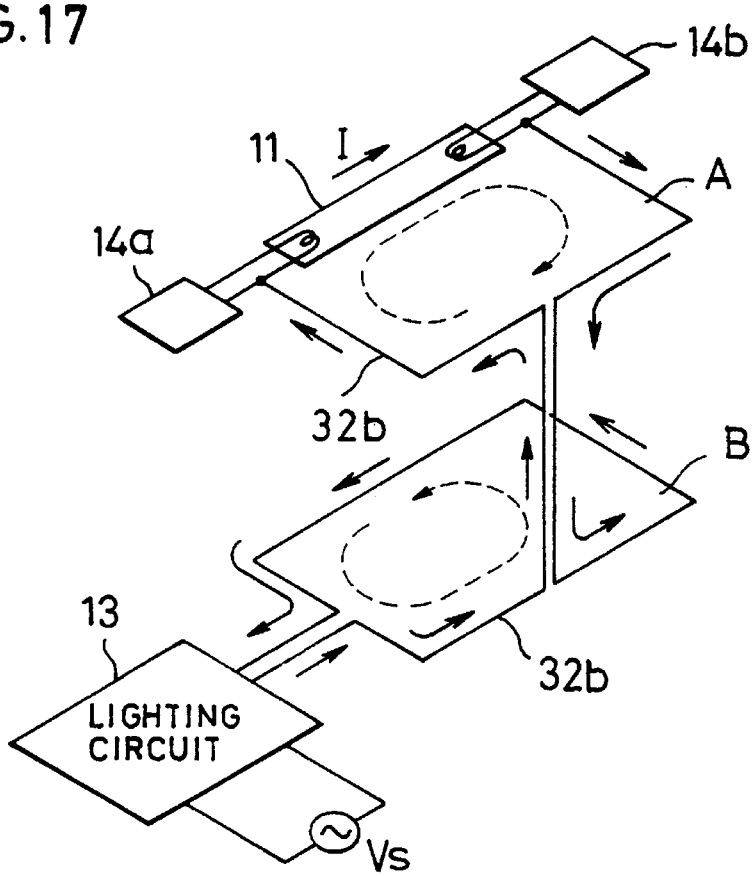
FIGS. 17 through 20 are explanatory views for further various embodiments of the present invention.

In another embodiment shown in FIG. 17 of the present invention, the fluorescent lamp 11 is provided with the same loop arrangement as that in the embodiment of FIGS. 15 and 16, in which event the preheating circuits 14*a* and 14*b* are connected respectively to each end electrode of the fluorescent lamp, preferably as has been described with reference to the embodiment of FIG. 11, for improving startability. In the present embodiment, too, the same effect of restraining the noise occurrence as in the case of FIGS. 15 and 16 can be obtained.

Figure 18:
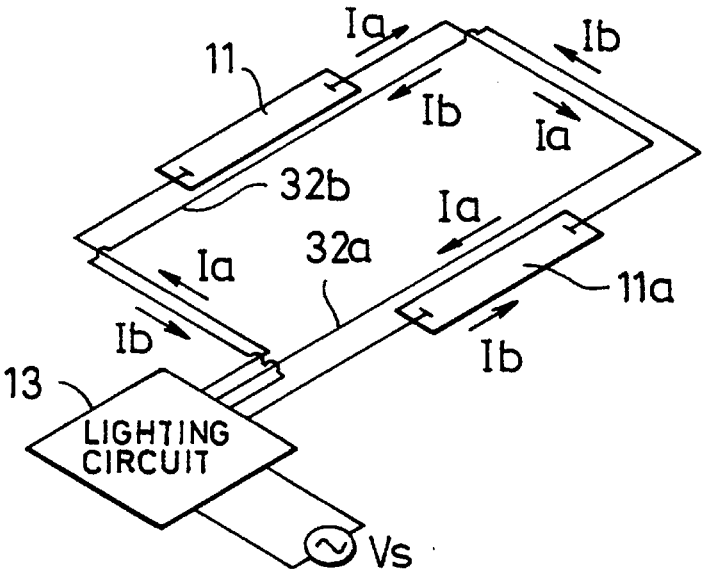

In another embodiment of the present invention as shown in FIG. 18, a pair of the loop means 32*a* and 32*b* mutually of the same shape in the substance are disposed substantially on the same plane, and such a pair of lamps 11 and 11*a* as the HID lamps are connected respectively in each of the loop means 32*a* and 32*b*. In this event, too, the lamp current Ia flowing in one loop means 32*a* flows in the reverse direction to the lamp current Ib in the other loop means 32*b*, so that the magnetic fields generated in the respective loop means 32*a* and 32*b* upon the current supply to the lamps 11 and 11*a* are mutually cancelled, and the noise occurrence can be effectively restrained.

Figure 19:
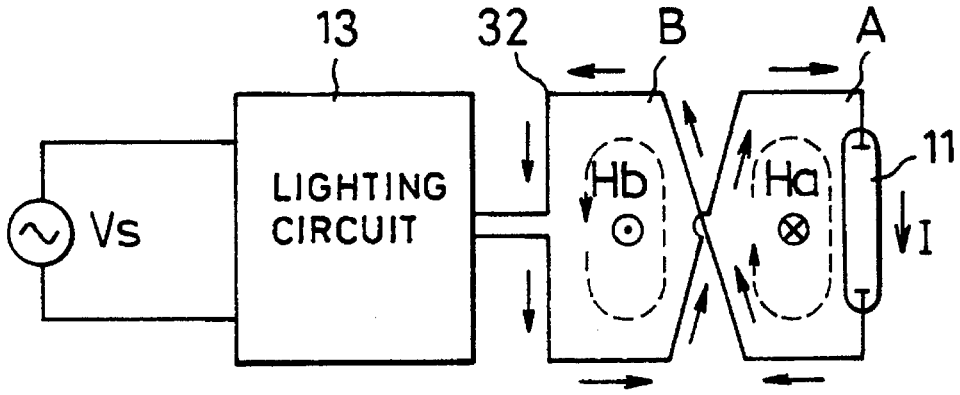
Figure 20:
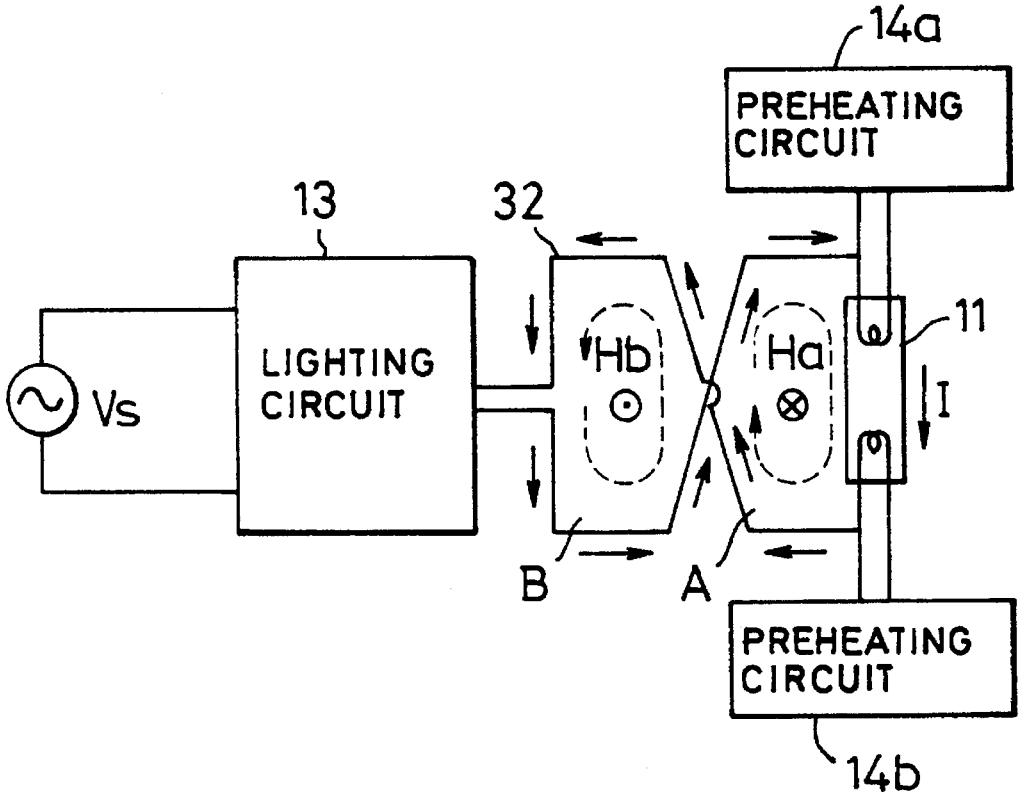

In another embodiment of the present invention as shown in FIG. 19, the loop means 32 connecting between the lighting circuit 13 connected to the power source Vs and the HID lamp employed as the lamp 11 is formed to have two loop regions A and B which are disposed substantially on the same plane, the regions A and B being formed by, for example, twisting or partly rotating once by 180 degrees a normal planar loop substantially in the center thereof so that both side wires at the twisted part will intersect each other. Also in this event, the magnetic fields Ha and Hb generated at the respective loop regions A and B are mutually in the reverse direction to cancel each other, and the noise occurring due to the magnetic field can be remarkably reduced. In another embodiment shown in FIG. 20, the fluorescent lamp is employed as the lamp 11 in the same loop arrangement as in FIG. 19, except for the provision of the preheating circuits 14*a* and 14*b*, so that the magnetic fields Ha and Hb can be also effectively cancelled in the case where the fluorescent lamp is used, so as to remarkably reduce the noise occurrence.

Figure 21:
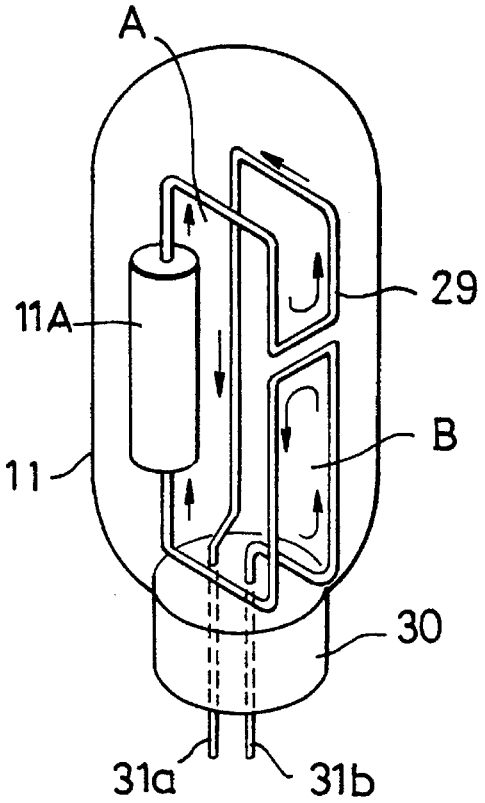
FIGS. 21 and 22 show in perspective views further different embodiments of the present invention.
Figure 22:
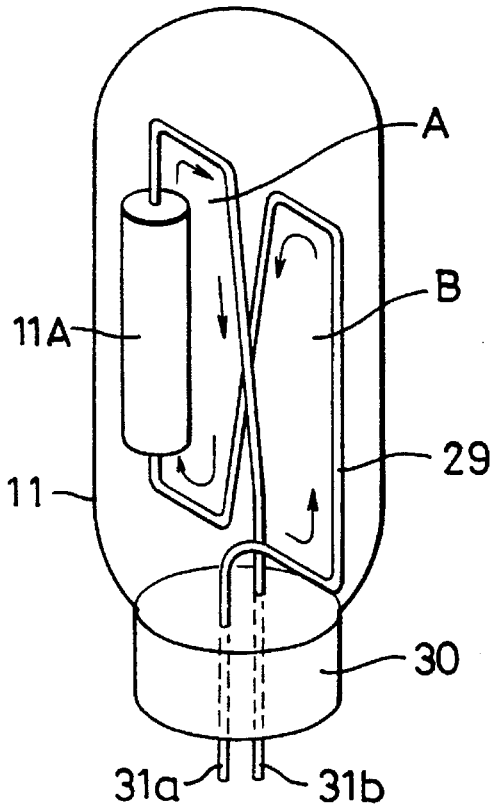

Referring to FIG. 21, there is shown another embodiment of the present invention, in which the lamp 11 encloses therein the loop means 29 having the two loop regions A and B mutually opposing substantially in symmetrical relationship for cancelling their magnetic fields. These loop regions A and B are connected at their one end to each of both end electrodes of the luminous tube 11A in the lamp 11 and at the other end to each of the leading terminal pins 31*a* and 31*b* held through the base 30 of the lamp 11. In this event, too, the magnetic fields generated in both loop regions A and B are effectively mutually cancelled, and the noise reduction can be attained. In another embodiment of the present invention as shown in FIG. 22, substantially the same lamp 11 as in FIG. 21 is provided, except that the loop regions A and B of the loop means 29 are disposed substantially on the same plane and twisted intermediately as referred to in respect of FIG. 20, and the remarkable noise reduction can be well attained.

Figure 23:
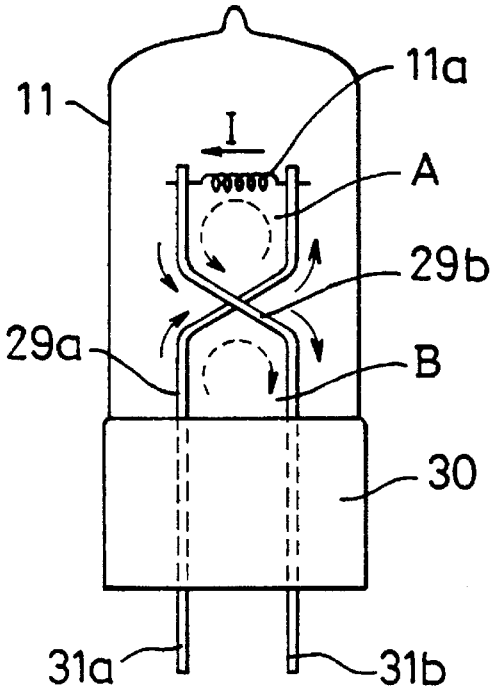
FIG. 23 shows in an elevation another embodiment of the present invention.
Figure 24:
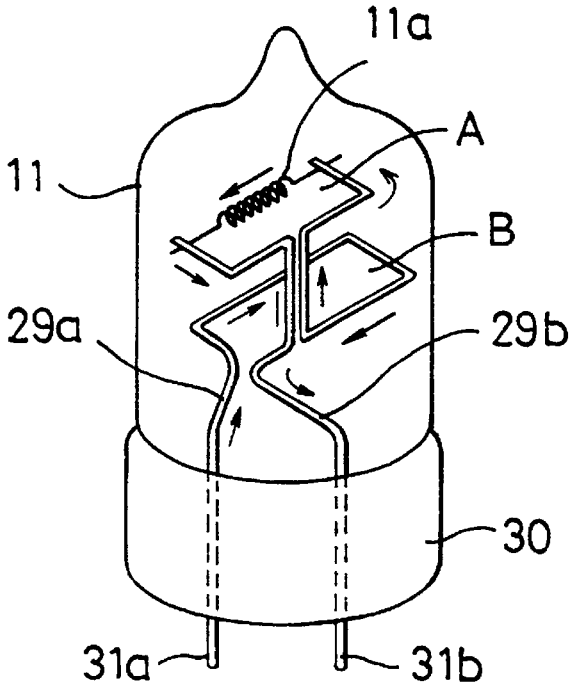
FIG. 24 shows in a perspective view another embodiment of the present invention.

In another embodiment shown in FIG. 23 of the present invention in which the incandescent lamp is employed as the lamp 11, such twisted type loop means 29 having the two loop regions A and B is provided within the lamp, and the loop regions A and B are formed by two loop-forming wires 29*a* and 29*b* intermediately intersecting each other and connected at one end to the leading terminal pins 31*a* and 31*b* held through the base 30 of the lamp and at the other end to each of both ends of the filament 11*a,* whereby the same loop regions A and B as in the foregoing embodiments are defined, the magnetic fields generated in these loop regions are caused to be mutually cancelled, and the remarkable noise reduction can be attained. In FIG. 24 of another embodiment of the present invention, substantially the same lamp as that of FIG. 23 is provided except for the disposition of the two loop regions A and B of the loop means 29 to be above and below as in the case of FIG. 16, and the noise occurrence can be sufficiently restrained in the same manner.

Figure 25:
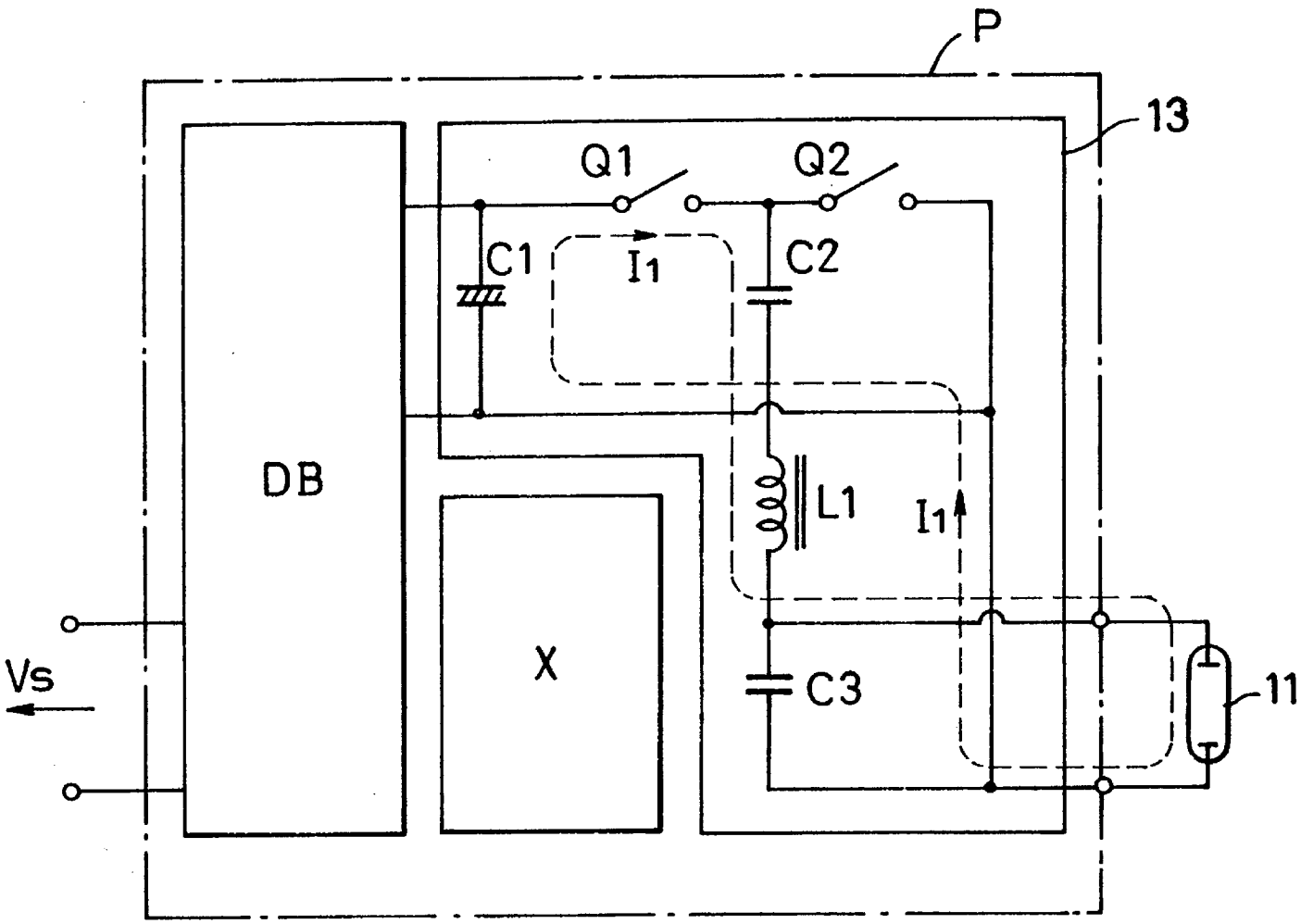
FIG. 25 is a concrete circuit diagram of the luminaire in another embodiment according to the present invention.
Figure 26:
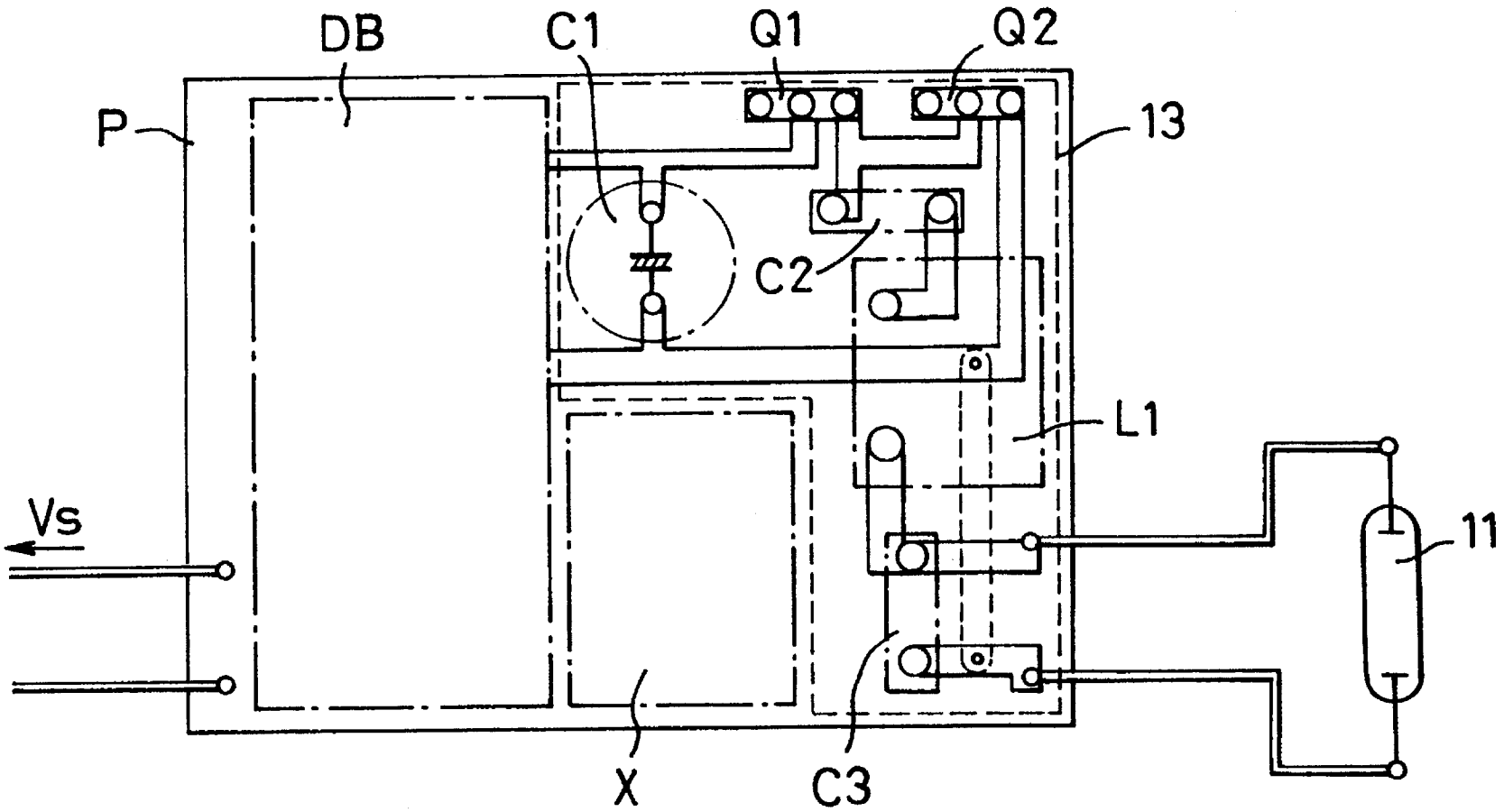
FIG. 26 is an explanatory view for a working aspect of the disposition of various circuit elements and the wiring loops in respect of the printed circuit board in the embodiment of FIG. 25.
Figure 27:
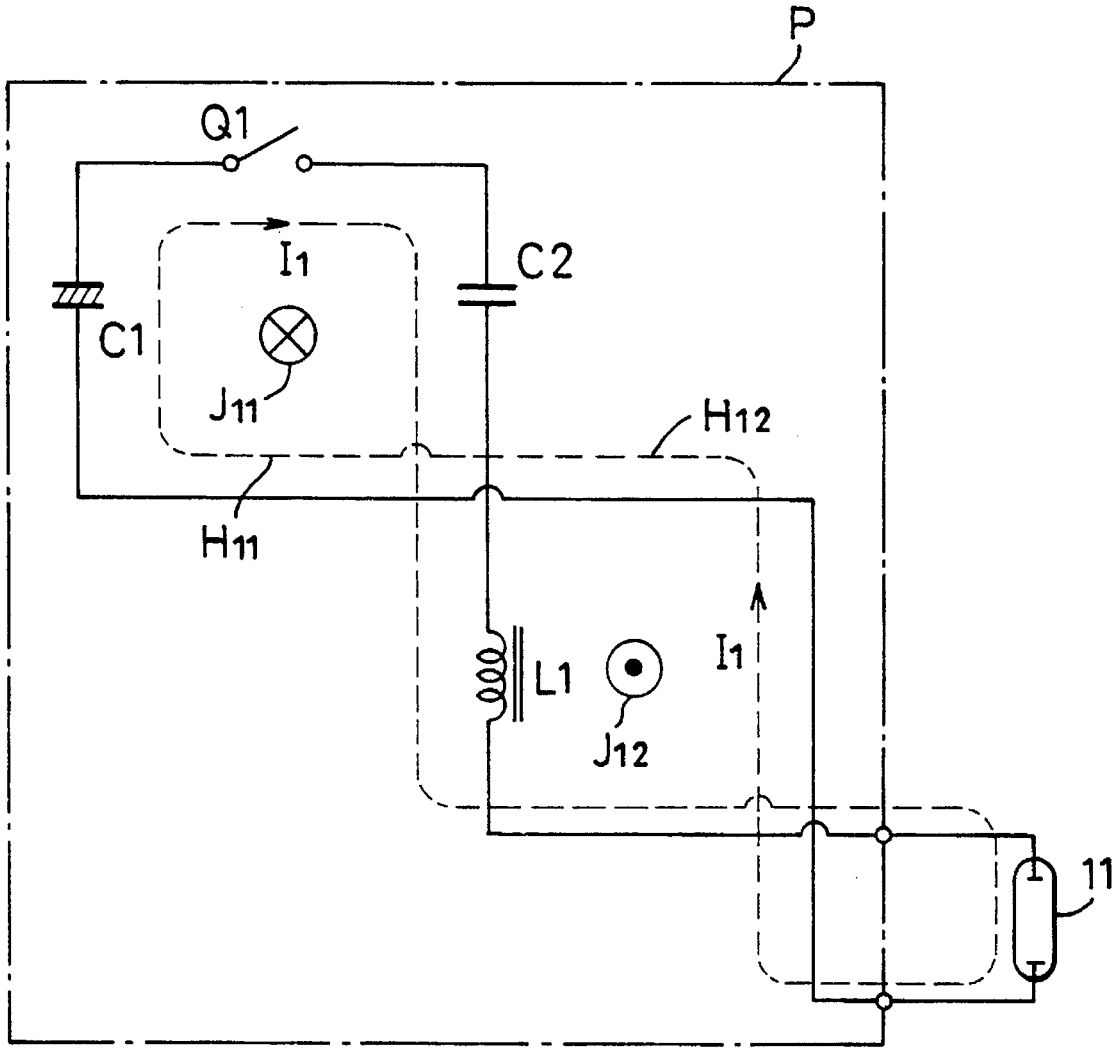
FIG. 27 is an explanatory view for an aspect of the current flowing in the luminaire in the embodiment of FIG. 25.

Referring to FIGS. 25 and 26 showing another embodiment of the present invention, there is taken a measure for practicing the present invention in respect of the printed circuit board. On the printed circuit board P in the present instance, the lighting circuit 13 is connected to a diode bridge DB to be connected to the power source Vs, and a circuit including the lamp 11 is connected to the lighting circuit 13. In this case, the lamp current is made to flow through a path $I_1$ formed from an output terminal of the diode bridge DB, smoothing capacitor C1, switching element Q1, capacitor C2, inductor L1, lamp 11 and again smoothing capacitor C1. In this respect, the printed circuit board P is so formed that, in the current path $I_1$, part of connecting wire between the capacitor C2 and the inductor L1 and part of connecting wire between negative side of the smoothing capacitor C1 and the lamp 11 intersect each other. With this arrangement, as also shown in FIG. 27, there are formed two closed loops $H_{11}$ and $H_{12}$, in which the magnetic fields $J_{11}$ and $J_{12}$ are generated in accordance with the current flowing direction, the magnetic fields $J_{11}$ and $J_{12}$ mutually of opposite directions are to cancel each other, and the noise occurring due to the generation of the magnetic field can be remarkably reduced. If, in this case, the two closed loops $H_{11}$ and $H_{12}$ could be reduced in the surface area, it would be possible to render the radiation noise generated from the lighting circuit 13 of the high frequency to be substantially at zero level. Further, the lighting circuit 13 is adapted only to the erasing of the magnetic field without requiring any of such special measures as a noise preventing means or the like, electronic elements or the lighting circuit 13 and ambient devices are not influenced, and the arrangement is useful in rendering required costs to be lowered and in minimizing the size.

In the present invention, various design modifications are possible. While, for example, the loop means has been described to have been formed to be branched into two sections or to define two loop regions, it is also possible to dispose three or more sections or regions for improving the function of restraining the noise occurrence.

What is claimed is:

1. A luminaire comprising a power source, a lighting circuit connected to said power source and providing an output containing a high frequency component, a pair of output wires connected to said lighting circuit for receiving said output, a lamp connected to said pair of output wires, a first current loop including one of said pair of output wires and said lamp, and formed for generating a magnetic field, and a second current loop formed for generating a further magnetic field in a direction capable of cancelling said magnetic field generated by said first current loop, and including the other of said pair output wires, one of said output wires connected to said lighting circuit being connected to a first end of said lamp while the other of said output wires being branched into a plurality of branch output wires which extend along said lamp to dispose the lamp between said branch output wires and connected to a second end of said lamp, wherein at least one of said first and second current loops comprises reflector plates of a conductive material and encircling part of said lamp.

2. A luminaire comprising:

a power source;

a lamp including a pair of electrodes connected to said power source and means for emitting light;

a reflector plate encircling part of said lamp;

a lighting circuit connected between said power source and said lamp for providing to said lamp an output including a high frequency component through at least a pair of output wires, one of the pair of output wires being connected to one of the pair of electrodes and the other of the output wires being connected to the other of the pair of electrodes for lighting said lamp, and at least a pair of branch wires connected between one of said pair of output wires and a corresponding one of the pair of electrodes of said lamp, respectively, said branch wires being disposed along said reflector plate on first and second sides of said lamp, respectively, to form first and second current loops together with the electrodes of the lamp, respectively, each current loop generating a magnetic field where the magnetic field generated by the first current loop cancels the magnetic field generated by the second current loop.

3. The luminaire according to claim 2 wherein the first and second current loops are disposed on the same plane.

4. The luminaire according to claim 2 wherein the first and second current loops intersect each other on an axial line of said lamp.

5. The luminaire according to claim 2 wherein said reflector plate includes a pair of electrically conductive parts respectively disposed on first and second sides of said lamp.

* * * * *